United States Patent [19]

Steadman et al.

[11] Patent Number: 4,601,228

[45] Date of Patent: Jul. 22, 1986

[54] PRESS KNIVES

[76] Inventors: Michael Steadman, 9 Francis Dickins Close, Wollaston, Northamptonshire; Ronald H. Luck, 79 The Headlands, Weston Favell, Northampton, both of England

[21] Appl. No.: 562,468

[22] Filed: Dec. 16, 1983

[30] Foreign Application Priority Data

Dec. 21, 1982 [GB] United Kingdom ..... 8236319

[51] Int. Cl.[4] ..... A43D 7/12

[52] U.S. Cl. ..... 83/862; 83/652; 12/52.5

[58] Field of Search ..... 83/862, 652–657; 101/30, 368; 69/2; 76/107 C; 12/52.5

[56] References Cited

U.S. PATENT DOCUMENTS

| | | | |
|---|---|---|---|
| 1,097,247 | 5/1914 | Lund | 12/52.5 |
| 2,056,321 | 10/1936 | Haumont | 76/107 C |
| 2,124,591 | 7/1938 | Ryan | 83/652 X |
| 2,791,273 | 5/1957 | Brownell | 83/652 |
| 2,846,001 | 8/1958 | Lowell | 83/652 X |
| 3,688,325 | 9/1972 | Panter et al. | 83/652 X |
| 3,698,028 | 10/1972 | Panter et al. | 83/652 X |

*Primary Examiner*—James M. Meister

[57] ABSTRACT

The invention relates to a press knife for cutting sheet material, comprising a continuous length of blade (2) in the shape of a desired outline to be cut in sheet material and having at least one continuous cutting edge (4) and preferably two, said knife also having at least one elongate reinforcing member (6) extending transversely of the knife and linking one portion of the blade with a generally oppositely disposed portion. The knife is provided with two support plates (8) shaped to fit within the perimeter of the continuous blade (2) and arranged so that the reinforcing member (6) lies between the plates (8), and at least one making strip (4) received in a slot (12) of one plate (8) and in a congruently disposed slot (12) in the second plate so as to bridge the two plates and retain them in position with respect to the blade.

6 Claims, 5 Drawing Figures

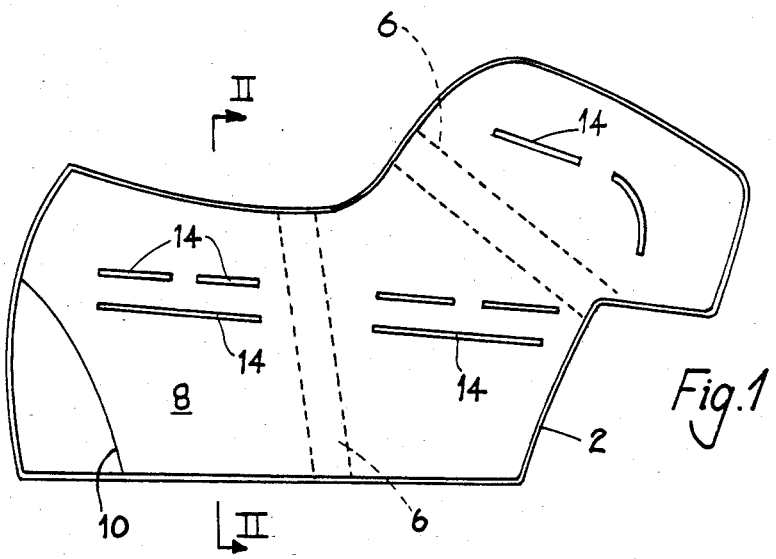
Fig.1
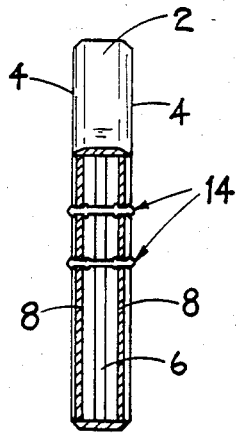
Fig.2.
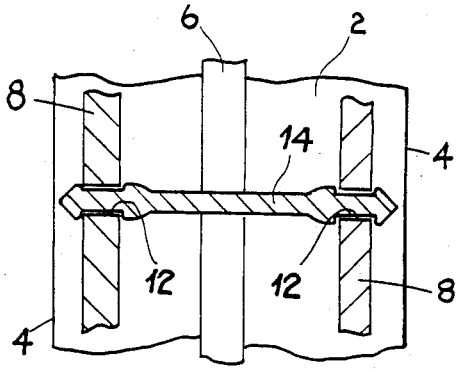
Fig.3.
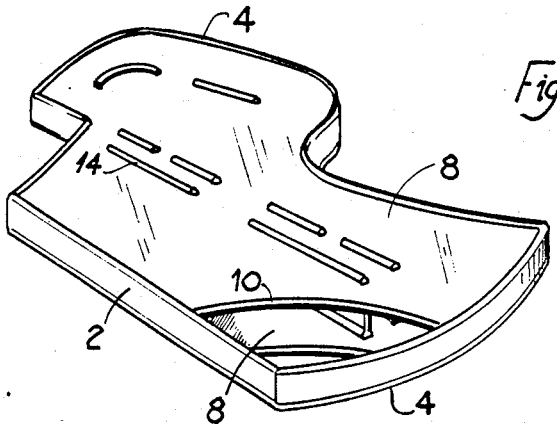
Fig.4.
Fig.5.
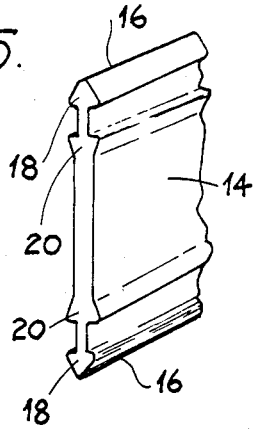

PRESS KNIVES

The invention is concerned with improvements in or relating to press knives.

It is well known to cut sheet material, for example leather or poromeric plastics material for use in the manufacture of footwear, by laying the material upon the bed of a press of a suitable type and placing a press knife, usually referred to as a clicking knife, on the surface of the material prior to applying pressure from a press head to force the edge of the knife through the material. The press head may be operated hydraulically or by any suitable power means.

Where the material is to be used in the manufacture of footwear, it is conventional practice to cut portions of the footwear uppers, such as vamps and quarters, from the sheet using a click knife, and then to apply to the surface of the cut upper portion a pattern of marking, either by indentation or by transfer of a suitable marking medium, for example ink, to act as a guide for subsequent assembly of the upper portion to other upper portions by means of stitching or welding.

It is an object of the invention to provide a press knife which is capable of cutting and marking portions of sheet material in a single operation.

According to the invention there is provided a press knife comprising a continuous length of blade extending in a closed loop and having its opposite lengthwise edges extending in parallel planes, one of which edges constitutes an endless cutting edge, a support plate secured within the loop of the blade at a location set back from said cutting edge and having at least one slot extending therethrough, and a marking strip mounted in the or each slot and projecting from the slot towards the plane of said cutting edge.

The invention also provides a press knife comprising a continuous length of blade extending in a closed loop defining a desired shape to be cut from sheet material at least one edge of which provides an endless cutting edge extending in a plane, at least one elongate reinforcing member extending chordwise of the blade and connected at its opposite ends to the blade, two support plates shaped to fit within the perimeter of the continuous blade and arranged so that the reinforcing member lies between said plates, the two plates having slots therein, the slot or slots in each plate being congruent with the slot or slots in the other plate, and at least one marking strip located in a slot of one of the plates and in a congruent slot in the second plate so as to bridge the two plates, opposite edges of each marking strip projecting beyond the two plates respectively towards the plane of the cutting edge.

The support plates are preferably slidable at right angles to said plane relative to the blade.

It will be understood that there may be one marking strip disposed at a location between two elongate reinforcing members in order to obtain the necessary retention, or where there is only one reinforcing member, there may be at least two marking strips, one on each side of the reinforcing member. Within practical limits, there may, of course, be any desired number of marking strips or reinforcing members.

The marking strip(s) may be formed from a continuous length of any suitable strip material and have a constant cross section which may conveniently be provided with a first shoulder portion at a marginal portion of the strip and bearing a marking edge, and a second shoulder portion spaced slightly inwardly of the first shoulder portion by an amount approximately equal to the thickness of the support plate so that lip portions of the slot formed therein are received between the two shoulder portions of the strip.

Conveniently, the blade has two cutting edges to ensure that when the upper portions of a pair of shoes are cut, there is exact mirror-image identity between the corresponding portions of the left and of the right shoe. Thus the marking strip will have two marking edges and four shoulder portions.

There will now be described an example of a press knife according to the invention. It will be understood that the description which is to be read with reference to the drawings is given by way of example only and not by way of limitation.

In the drawings:

FIG. 1 is a plan view of a press knife according to the invention;

FIG. 2 is a cross-section on line II—II of FIG. 1;

FIG. 3 is an enlarged fragmentary view of FIG. 2;

FIG. 4 is a perspective view of the knife;

FIG. 5 is a portion of marking strip.

The press knife to be described comprises a continuous length of steel blade 2 opposite lengthwise edges of which are sharpened to provide two cutting edges 4 respectively extending in parallel planes, enabling the knife to be used for cutting two mirror-image quarters. Two elongate reinforcing members 6 each span the blade chordwise and have their ends secured to the blade by brazing, welding or any other convenient means.

Two support plates 8, cut from any suitable stiff board or in the present example from polypropylene sheet, are received within the perimeter of the blade so as to fit closely thereto but to be capable of sliding movement relative to the blade in a direction normal to the planes of the cutting edges. A gap 10 is left for ease of handling the knife, for example receiving a storage rod or hook. Each plate bears a plurality of slots 12 (FIG. 3) forming a pattern. The reinforcing members 6 lie between the two plates 8, which are retained in position by means of a plurality of marking strips 14 cut to length to be received with the slots 12 of the support plates.

The marking strip of the present example is formed from a strip of stiffly rigid polyvinylchloride (P.V.C.) having a constant cross-section and is provided with two marking edges 16 more clearly shown in FIG. 5. Each edge 16 is formed on a shoulder portion 18 of the strip cross section. Inwardly of shoulder portion 18 is provided a second shoulder portion 20 at a distance corresponding to the thickness of the support plates 8, so that opposite major surfaces of each plate abut the shoulder portions 18. The depth of the strip from one edge 16 to the opposite edge 16 is slightly less than the depth of the blade. When the knife is placed on the leather the support plates slide relative the blade into a position near the surface of the leather, and as the press forces the knife through the leather it also presses the marking strips against the surface of the leather.

Thus the marking strips 14 are thus held captive in their correct positions within the perimeter of the blade by spanning the support plates 8. The support plates are prevented from sliding out of the blade by the reinforcing member 6 disposed between them.

While the example above describes a marking strip which is P.V.C., it will be understood that any suitable material may be selected, for example nylon, or metal such as aluminium.

We claim:

1. A press knife comprising a continuous length of blade extending in a closed loop defining a desired shape to be cut from sheet material and having at least one endless cutting edge extending in a plane, at least one elongate reinforcing member extending chordwise of the blade and connected at its opposite ends to the blade, two support plates disposed parallel to each other on opposite sides of the reinforcing member which support plates are connected together and are shaped to fit within the perimeter of the continuous blade and closely to the blade so as to be located for sliding movement relative to the blade in a direction normal to said plane, the two plates having slots therein, the slot or slots in each plate being aligned with the slot or slots therein, the slot or slots in each plate being aligned with the slot or slots in the other plate, and at least one marking strip located in a slot of one of the plates and in the aligned slot in the other plate so as to bridge the two plates, opposite edges of each marking strip projecting beyond the two plates respectively whereby the marking strip can move relative to the blade in said direction normal to said plane.

2. A press knife as claimed in claim 1 and having two of said elongate reinforcing members and one said marking strip disposed at a location between said two elongate reinforcing members.

3. A press knife as claimed in claim 1 wherein each marking strip has, where the strip extends through a slot in each of the plates, two shoulders spaced apart and respectively abutting opposite major surfaces of the plate.

4. A press knife as claimed in claim 3 wherein the blade provides two endless cutting edges and each marking strip has two marking edges respectively formed on said portions thereof projecting beyond the two plates.

5. A press knife as claimed in claim 4, wherein the depth of the blade between said two cutting edges is greater than the depth of the strip between the two marking edges thereof.

6. A press knife as claimed in claim 1, wherein edges of the two support plates are received within the blade perimeter to fit closely thereto except for one region in which an edge of each plate is spaced from the blade to form an aperture.

* * * * *